US008727243B2

(12) United States Patent
Saito et al.

(10) Patent No.: US 8,727,243 B2
(45) Date of Patent: May 20, 2014

(54) ELECTROMAGNETIC FUEL INJECTION VALVE

(75) Inventors: Kenichi Saito, Kakuda (JP); Kazuhiko Sato, Kakuda (JP)

(73) Assignee: Keihin Corporation, Tokyo (JP)

( * ) Notice: Subject to any disclaimer, the term of this patent is extended or adjusted under 35 U.S.C. 154(b) by 355 days.

(21) Appl. No.: 13/386,470

(22) PCT Filed: May 21, 2010

(86) PCT No.: PCT/JP2010/058607

§ 371 (c)(1),
(2), (4) Date: Mar. 9, 2012

(87) PCT Pub. No.: WO2011/013435

PCT Pub. Date: Feb. 3, 2011

(65) Prior Publication Data

US 2012/0160938 A1 Jun. 28, 2012

(30) Foreign Application Priority Data

Jul. 27, 2009 (JP) ..... 2009-173905

(51) Int. Cl.
*B05B 1/30* (2006.01)
*F02M 51/06* (2006.01)

(52) U.S. Cl.
CPC ..... *F02M 51/0646* (2013.01); *F02M 51/065* (2013.01); *F02M 51/0657* (2013.01); *Y10S 239/90* (2013.01)
USPC ..... 239/585.1; 239/585.3; 239/585.5; 239/900

(58) Field of Classification Search
CPC . F02M 51/06; F02M 51/065; F02M 51/0657; F02M 51/0646; F02M 51/0639
USPC ..... 239/585.1, 585.3, 585.5, 900
See application file for complete search history.

(56) References Cited

U.S. PATENT DOCUMENTS 6,062,499 A 5/2000 Nakamura et al.
7,048,202 B2 * 5/2006 Bierstaker et al. ..... 239/5

(Continued)

FOREIGN PATENT DOCUMENTS

EP 1 672 213 A1 6/2006
EP 1 798 410 A1 6/2007

(Continued)

*Primary Examiner* — Dinh Q Nguyen
(74) *Attorney, Agent, or Firm* — Carrier Blackman & Associates, P.C.; Joseph P. Carrier; William D. Blackman

(57) ABSTRACT

In an electromagnetic fuel injection valve, a valve body guide hole (15) which is connected to a valve seat (8) of a valve seat member (3) and slidably guides a valve body (14), and a large-diameter hole (17) which is connected to a rear end of the valve body guide hole (15) via a tapered hole (16) and has a diameter larger than that of the valve body guide hole (15), are provided in the valve seat member (3) of a valve housing (2), whereas a first longitudinal hole (19) which communicates with a fuel intake cylinder (26) is provided in a fixed core (5); a second longitudinal hole (20) which communicates with the first longitudinal hole (19) is provided from a movable core (12) to a valve shaft (13); a traverse hole (21) which opens the second longitudinal hole (20) to the large-diameter hole (17) is provided in the valve shaft (13); and a relationship between the diameter (D1) of the large-diameter hole (17) and the diameter (D2) of the valve body guide hole (15) satisfies D2/D1<0.6. Thus, it is possible to provide an electromagnetic fuel injection valve which atomizes the injected fuel in a good condition and is compact in size.

3 Claims, 3 Drawing Sheets

(56) References Cited

U.S. PATENT DOCUMENTS

| | | | | |
|---|---|---|---|---|
| 7,159,800 | B2 * | 1/2007 | Peterson, Jr. | 239/533.2 |
| 7,793,417 | B2 * | 9/2010 | Akabane | 29/888.4 |
| 8,002,207 | B2 | 8/2011 | Hashii et al. | |

FOREIGN PATENT DOCUMENTS

| | | | |
|---|---|---|---|
| JP | 2001-115923 | A | 4/2001 |
| JP | 2007-032342 | A | 2/2007 |
| WO | 2008/117459 | A1 | 10/2008 |

* cited by examiner

ELECTROMAGNETIC FUEL INJECTION VALVE

TECHNICAL FIELD

The present invention relates to an electromagnetic fuel injection valve that is mainly used in a fuel supply system of an internal combustion engine and, in particular, to an improvement of an electromagnetic fuel injection valve that includes: a valve housing including a valve seat member, a fixed core and a fuel intake cylinder which are connected in a fore-and-aft direction, an inside of the valve housing serving as a fuel passage, and the valve seat member having a valve seat and a valve hole at a front end thereof; a coil placed around an outer periphery of the valve housing, and electrified in order to excite the fixed core; and a valve assembly which is housed in the valve housing, and opens and closes the valve hole in cooperation with the valve seat in conjunction with demagnetization and excitation of the fixed core, the valve assembly including a valve body, a movable core and a valve shaft, the valve body being detached from and seated on the valve seat, having a spherical basic shape, and having a plurality of passage portions in an outer periphery thereof, the movable core being slidably fitted into the valve housing, and the valve shaft being integrally projectingly provided to a front end of the movable core and connected to the valve body, having a diameter smaller than that of the movable core.

BACKGROUND ART

Such electromagnetic fuel injection valve is already known as disclosed in Patent Document 1 below.

PRIOR ART DOCUMENT

Patent Document

Patent Document 1: Japanese Patent Application Laid-open No. 2001-115923

SUMMARY OF THE INVENTION

Problems to be Solved by the Invention

In the electromagnetic fuel injection valve disclosed by Patent Document 1, the fixed core is provided with a first longitudinal hole communicating with the inside of the fuel intake cylinder, while the movable core is provided with: a second longitudinal hole communicating with the first longitudinal hole; and multiple traverse holes which make the second longitudinal hole open to the rear-end surface of the valve seat member. For this reason, when the valve body is opened, large pressure loss occurs because high-pressure fuel having passed through the traverse holes via the second longitudinal hole collides against the rear-end surface of the valve seat member. This is a factor of hindering the injected fuel from being atomized. In addition, the total length of the movable core needs to be long for the purpose of compensating for the reduction in the capacity of the movable core which is caused by the traverse holes. This hinders the electromagnetic fuel injection valve from being made compact in size.

The present invention has been made with the foregoing situation taken into consideration. An object of the present invention is to provide an electromagnetic fuel injection valve in which the pressure loss of the fuel in the valve housing is small, which does not require the total length of the movable core to be long, as well as which is accordingly capable of atomizing the injected fuel in a good condition and is compact in size.

Means For Solving the Problems

In order to attain the above object, according to a first aspect of the present invention, there is provided an electromagnetic fuel injection valve including: a valve housing including a valve seat member, a fixed core and a fuel intake cylinder which are connected in a fore-and-aft direction, an inside of the valve housing serving as a fuel passage, and the valve seat member having a valve seat and a valve hole at a front end thereof; a coil placed around an outer periphery of the valve housing, and electrified in order to excite the fixed core; and a valve assembly which is housed in the valve housing, and opens and closes the valve hole in cooperation with the valve seat in conjunction with demagnetization and excitation of the fixed core, the valve assembly including a valve body, a movable core and a valve shaft, the valve body being detached from and seated on the valve seat, having a spherical basic shape, and having a plurality of passage portions in an outer periphery thereof, the movable core being slidably fitted into the valve housing, and the valve shaft being integrally projectingly provided to a front end of the movable core and connected to the valve body, having a diameter smaller than that of the movable core, characterized in that the valve seat member is provided with: a valve body guide hole which continues to the valve seat and slidably guides the valve body; and a large-diameter hole which continues to a rear end of the valve body guide hole via a taper hole, and whose diameter is larger than that of the valve body guide hole, the fixed core is provided with a first longitudinal hole which communicates with an inside of the fuel intake cylinder, a second longitudinal hole communicating with the first longitudinal hole is provided from the movable core to the valve shaft, the valve shaft is provided with a traverse hole which makes the second longitudinal hole open to the large-diameter hole, and a relationship between a diameter D1 of the large-diameter hole and a diameter D2 of the valve body guide hole is D2/D1<0.6.

Further, according to a second aspect of the present invention, in addition to the first aspect, a taper angle of the taper hole is set at 50° to 70°.

Furthermore, according to a third aspect of the present invention, in addition to the first or second aspect, the valve shaft includes: a hollow shaft portion having the second longitudinal hole; and a solid shaft portion which is solid, has a diameter smaller than that of the hollow shaft portion, and continues to a front end of the hollow shaft portion, and a cylinder-shaped passage is defined between the hollow shaft portion and an inner peripheral surface of the valve body guide hole by plunging a front-end portion of the hollow shaft portion into the valve body guide hole.

Effects of the Invention

In accordance with the first characteristic of the present invention it is possible to decrease the pressure loss because, when the valve body is opened, the high-pressure fuel having been on standby in the second longitudinal hole of the valve assembly flows smoothly to the large-diameter hole side with a relatively large volume in the valve seat member through the single traverse hole provided in the valve shaft. In addition, it is possible to atomize the injected fuel in a good condition because: the high-pressure fuel having moved to the large-diameter hole is guided to the valve body guide hole at a progressively higher flow speed while the flow of the high-pressure fuel is smoothly reduced by the taper hole; after passing through the multiple passage portions in the outer periphery of the valve body, the high-pressure fuel reaches the valve hole at an increasingly much higher flow speed while the flow of the high-pressure fuel is further reduced by the valve seat; and the high-pressure fuel is thus injected toward the front of the valve seat member at a high speed.

Further, it is possible to avoid a decrease in the capacity of the movable core which would otherwise be caused by the transverse, as well as contributes to making the movable core compact in size and resultantly the electromagnetic fuel injection valve compact in size, because the traverse hole is provided in the valve shaft while only the second longitudinal hole passes through the movable core. Furthermore, because the number of traverse holes provided to the valve shaft is one, when the traverse hole is made through electrical discharge machining or mechanical machining, not only is it possible to minimize the amount of produced burr and facilitate work for deburring as well as contribute to cost reduction, but also it is possible to reduce the diameter of the valve shaft while securing the strength of the valve shaft, and in conjunction with this, it is possible to increase the effective volume of the large-diameter hole.

Moreover, it is possible to effectively increase the flow speed of the high-pressure fuel from the large-diameter hole to the valve body guide hole, and concurrently to reduce the diameter of the spherical valve body which is supported by the valve body guide hole, because the relationship between the diameter of the valve body guide hole and the diameter of the large-diameter hole is as described above. It is possible to provide the small-sized electromagnetic fuel injection valve of a small injection flow rate type which is effective, especially, for a small-sized two-wheeled motor vehicle or the like.

In accordance with the second aspect of the present invention, because the taper angle of the taper hole, which connects the large-diameter portion and the valve body guide hole together, is set at 50° to 70°, it is possible to reduce the flow of the high-pressure fuel more smoothly in the taper hole, and to inhibit an increase in the total length of the valve seat member to an utmost extent in cooperation with the above-mentioned expression, thereby contributing to making the electromagnetic fuel injection valve compact in size.

In accordance with the third aspect of the present invention, it is possible to simultaneously achieve the reduction in the thickness and weight of the valve shaft, as well as the securing of the strength of the valve shaft. In addition, when the valve body is opened, the flow of the high-pressure fuel, which has been reduced by the taper hole, is straightened by use of the cylinder-shaped passage, and is thereafter divided into the multiple passage portions in the outer periphery of the valve body. For this reason, despite the single traverse hole, it is possible to make the amounts of the flows divided into each passage portion equal, and accordingly to stabilize the direction in which the fuel is injected from the fuel injection holes.

EXPLANATION OF REFERENCE NUMERALS AND SYMBOLS

Figure 1:
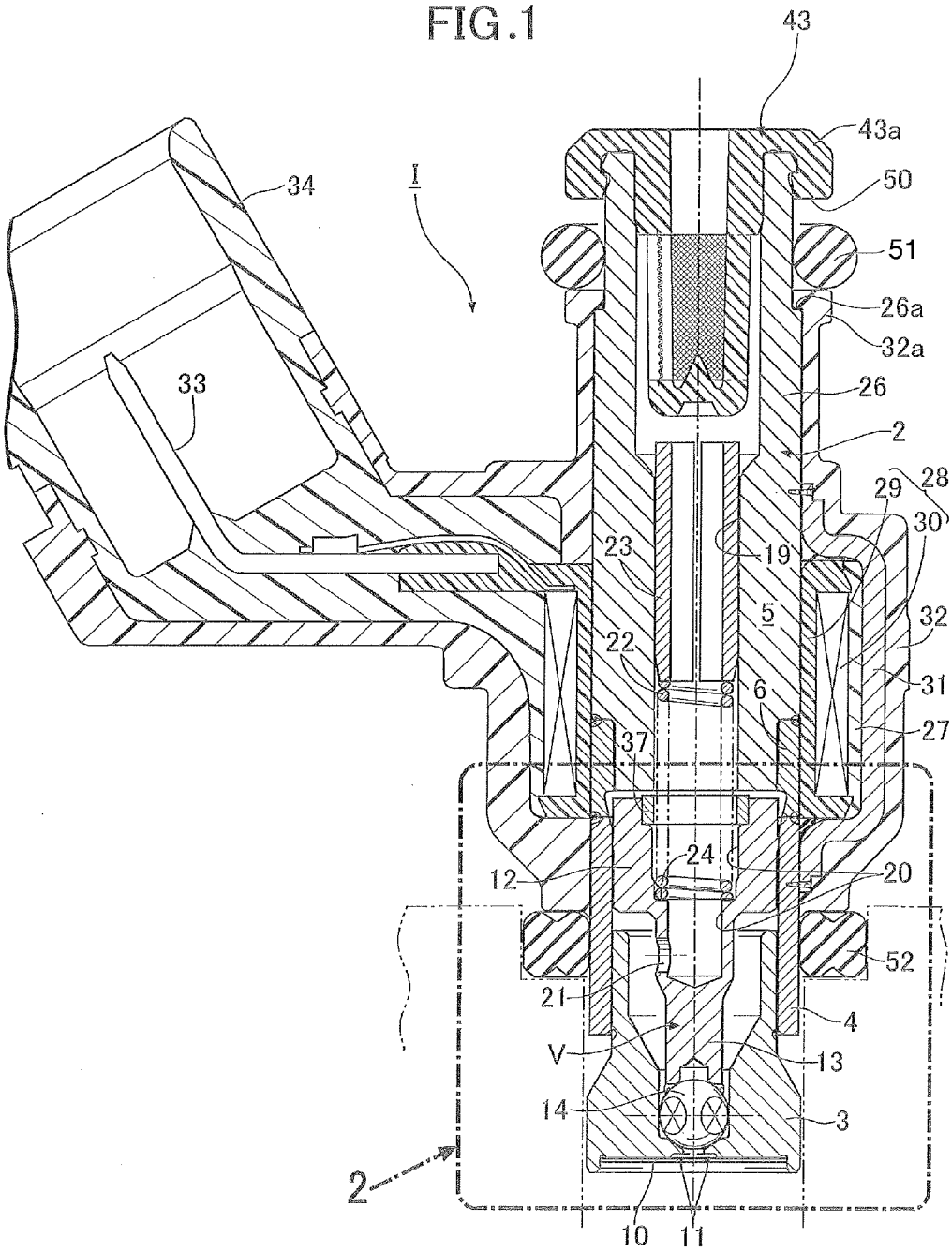
FIG. 1 is a longitudinal sectional view of an electromagnetic fuel injection valve related to an embodiment of the present invention. (first embodiment)

I electromagnetic fuel injection valve
2 valve housing
3 valve seat member
5 fixed core
7 valve hole
8 valve seat
12 movable core
13 valve shaft
13*a* hollow shaft portion
13*b* solid shaft portion
14 valve body
15 guide hole
16 taper hole
17 large-diameter hole
18 passage portion
19 first longitudinal hole
20 second longitudinal hole
21 traverse hole
25 cylinder-shaped passage
26 fuel intake cylinder
30 coil

MODE FOR CARRYING OUT THE INVENTION

A mode for carrying out the present invention will be thereinafter explained on the basis of a preferable example of the present invention which is shown in the attached drawings. It should be noted that: a direction toward a fuel-injection side of an electromagnetic fuel injection valve of the present invention is defined as frontward; and a direction toward a fuel-intake side of the electromagnetic fuel injection valve is defined as rearward.

Embodiment 1

In FIG. 1, a valve housing 2 of an electromagnetic fuel injection valve I for an engine includes: a cylinder-shaped valve seat member 3; a magnetic cylindrical body 4 fitted to and fluid-tightly welded to the rear-end part of the valve seat member 3; a non-magnetic cylindrical body 6 butted against and fluid-tightly welded to the rear end of the magnetic cylindrical body 4; a cylinder-shaped fixed core 5 whose front-end part is fitted in and fluid-tightly welded to the inner peripheral surface of the non-magnetic cylindrical body 6; and a fuel intake cylinder 26 integrally connected to the rear end of the fixed core 5 with the same material used for the fixed core 5.

Figure 2:
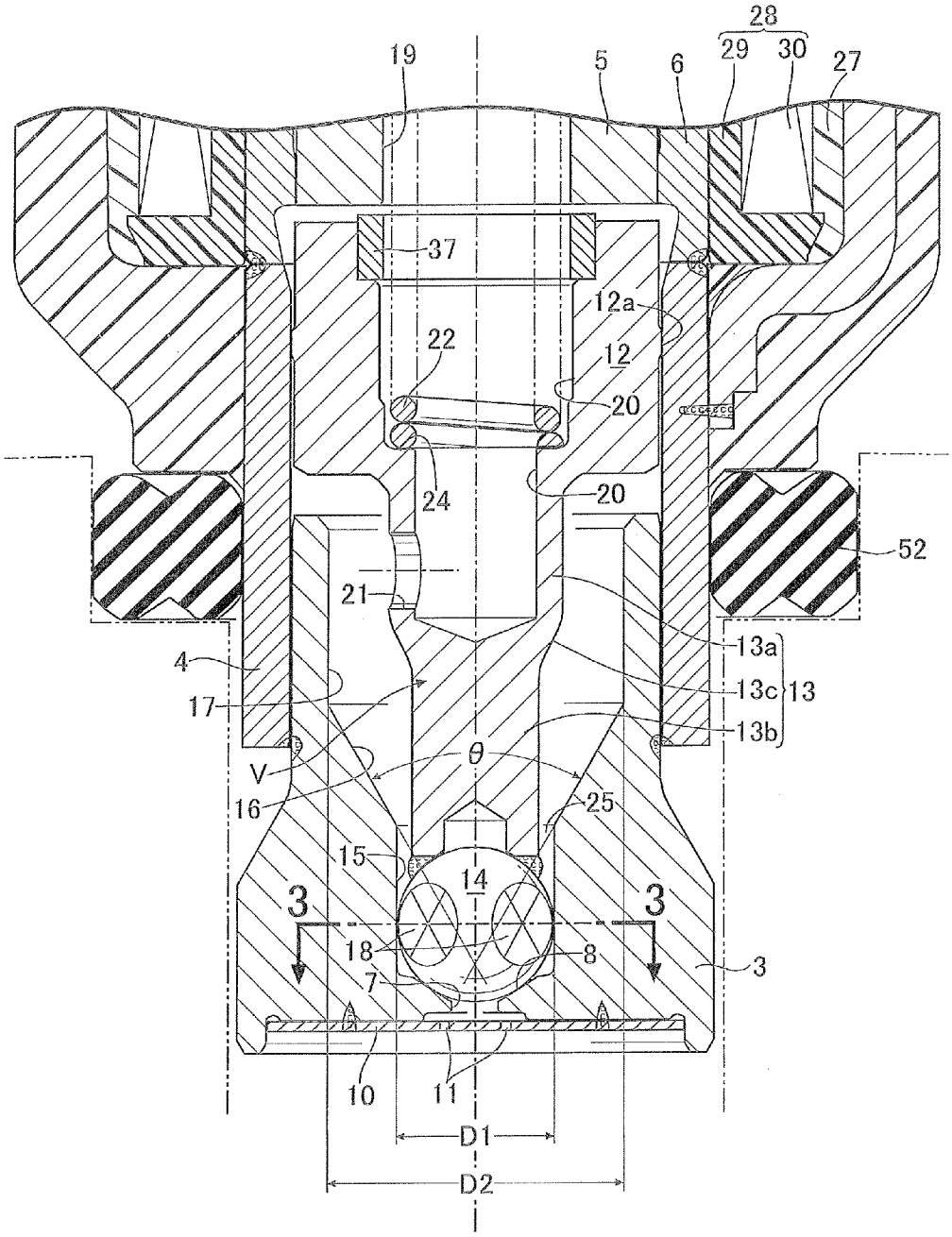
FIG. 2 is an enlarged view of part 2 in FIG. 1.

As shown in FIG. 2, the valve seat member 3 is provided with: a valve hole 7 opened in a front-end surface of the valve seat member 3; a cone-shaped valve seat 8 continuing to an inner end of the valve hole 7; a cylinder-shaped valve body guide hole 9 continuing to a large-diameter part of the valve seat 8; and a cylinder-shaped large-diameter hole 17 which is connected to a rear end of the valve body guide hole 15 via a taper hole 16, and whose diameter is larger than that of the valve body guide hole 15.

In this respect, the valve body guide hole 15 and the large-diameter hole 17 are formed in a way that satisfies Expression (1) expressed with $$D2/D1<0.6 \quad (1)$$

where D1 denotes the diameter of the valve body guide hole 15, and D2 denotes the diameter of the large-diameter hole 17.

In addition, a taper angle θ of the taper hole 16 is set at 50° to 60°.

An injector plate 10, made of a steel plate, which has multiple fuel injection holes 11 communicating with the valve hole 7, is fluid-tightly welded to the front-end surface of the valve seat member 3.

A part of the nonmagnetic cylindrical body 6 which is not fitted to the fixed core 5 is left in the front-end part of the nonmagnetic cylindrical body 6. A valve assembly V is housed in an inside of the valve housing 2 which extends from this part to the valve seat member 3.

Figure 3:
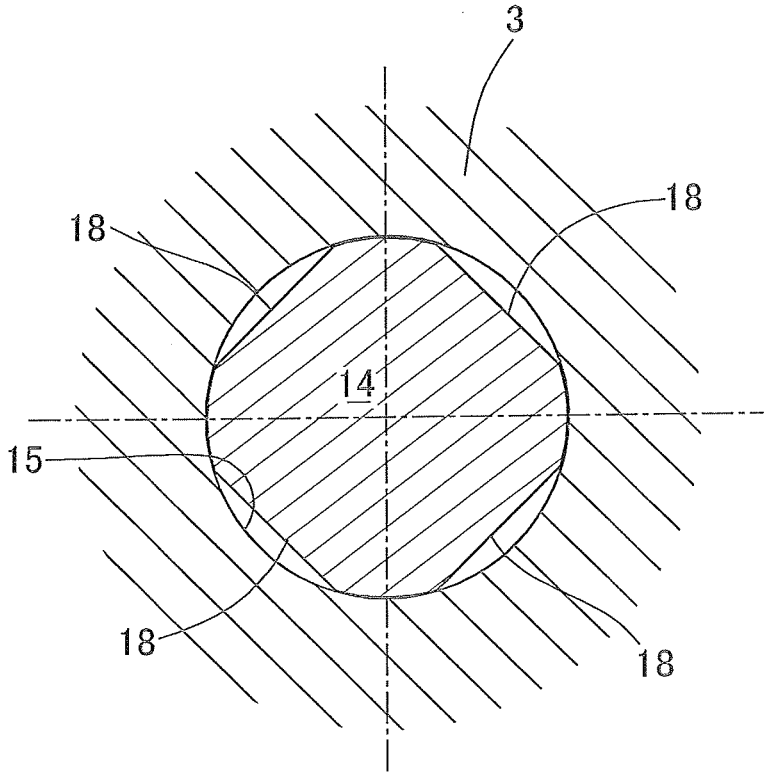
FIG. 3 is a sectional view along line 3-3 in FIG. 2. (first embodiment)

The valve assembly V is formed from: a valve body 14 whose basic shape is spherical, and which is slidably supported by the guide hole 9 so as to open and close the valve hole 7 in cooperation with the valve seat 8; a valve shaft 13 welded to and thereby connected to the valve body 14; and a cylinder-shaped movable core 12 which makes the valve shaft 13 integrally protrude from the front end of the movable core 12. The movable core 12 has an annular journal portion 12*a* which is slidably supported by the inner peripheral surface of the magnetic cylindrical body 4. The movable core 12 is placed opposite to the fixed core 5. Therefore, the opening and closing posture of the valve assembly V is designed to be stable because the valve assembly V is slidably supported by the valve housing 2 at two points, widely apart from each other, of the valve body 14 and the journal portion 12*a*. Multiple flat passage portions 18, 18, which allow fuel to pass through the passage portions, are formed around the spherical valve body 14 at equal intervals (see FIG. 3).

The fixed core 5 is provided with a first longitudinal hole 19 communicating with a hollow part of the fuel intake cylinder 26. In addition, the valve assembly V is provided with: a second longitudinal hole 20 starting at the rear-end surface of the movable core 12 and ending at an intermediate part of the valve shaft 13; and a single traverse hole 21 which makes the second longitudinal hole 20 open to the large-diameter hole 17 of the valve seat member 3.

The valve shaft 13 is formed from: a hollow shaft portion 13*a* which integrally protrudes from the front end of the movable core 12, and whose diameter is smaller than that of the movable core 12 and almost equal to that of the valve body guide hole 15, as well as which has the second longitudinal hole 20; and a solid shaft portion 13*b* which integrally continues to the front end of the hollow shaft portion 13*a* via a taper stepped portion 13*c*, and whose diameter is smaller than that of the valve body guide hole 15. During this process, a cylinder-shaped passage 25 is defined between the hollow shaft portion 13*a* and the inner peripheral surface of the valve body guide hole 15 by plunging the front end of the hollow shaft portion 13*a* into the valve body guide hole 15. In conjunction with this, a welded part between the hollow shaft portion 13*a* and the valve body 14 is located in the valve body guide hole 15.

As shown in FIGS. 1 and 2, an annular spring seat 24 directed toward the fixed core 5 is formed partway along the second longitudinal hole 20. A slotted pipe-shaped retainer 23 is press-fitted into the first longitudinal hole 19 of the fixed core 5. A valve spring 22 for urging the movable core 12 in a direction in which the valve body 18 closes the valve is compressedly installed between the retainer 23 and the spring seat 24. During this process, a set load of the valve spring 22 is adjusted by the depth to which the retainer 23 is fitted into the first longitudinal hole 19.

A ring-shaped stopper member 37 made of a non-magnetic material is embedded in the movable core 12. The stopper member 37 slightly protrudes from the rear-end surface of the moveable core 12 that faces the fixed core 5. The stopper member 37 is configured to leave a predetermined gap between the opposed end surfaces of the respective fixed and movable cores 5, 12 when the stopper member 37 comes in contact with the front-end surface of the fixed core 5 during the attraction of the fixed and movable cores 5, 12 to each other.

Corresponding to the fixed core 5 and the movable core 12, a coil assembly 28 is fittingly set on the outer periphery of the valve housing 2. The coil assembly 28 includes a bobbin 29 and a coil 30 wound therearound, the bobbin 29 being fitted onto outer peripheral faces from the rear-end part of the magnetic cylindrical body 4 to the fixed core 5. A base end part of a coupler terminal 33 projecting toward one side is held by the rear-end part of the bobbin 29, and the terminal of the coil 30 is connected to the coupler terminal 33. A first covering layer 27, made of synthetic resin, for covering the outer periphery of the coil 30 so as to embed and seal the coil 30 is molded around the coil assembly 28. During this process, a coupler 34 projecting toward one side of the coil assembly 28 with the coupler terminal 33 housed and held in the coupler 34 is formed integrally with the first covering layer 27.

Both the front-end and rear-end parts of a magnetic coil housing 31 surrounding the coil assembly 28 are welded respectively to the outer peripheral surfaces of the magnetic cylindrical body 4 and the fixed core 5.

Stretching from the rear half part of the magnetic cylindrical body 4 to the front half part of the fuel intake cylinder 26, a second covering layer 32, made of synthetic resin, which the coil assembly 28, the coil housing 31 and the bottom of the coupler 34 are embedded in and sealed by, is molded around the outer peripheral surfaces of the rear half part of the magnetic cylindrical body 4 and the front half part of the fuel intake cylinder 26. During this process, a thick portion 32*a*, which covers a rear stepped portion 26*a* of the fuel intake cylinder 26, is formed in the rear end of the second covering layer 32. An O-ring 51 is set around the outer peripheral surface of the fuel intake cylinder 26 between the thick portion 32*a* and an attachment flange 43*a* of a fuel filter 43 which is press-fitted into the inlet of the fuel intake cylinder 26. In addition, a seal member 52 to be in intimate contact with the front-end surface of the second covering layer 32 is set around the outer periphery of the magnetic cylindrical body 4.

Next, an operation of this embodiment is now explained.

High-pressure fuel, which is transferred from a fuel pump (not illustrated) to the fuel intake cylinder 26 under pressure, is filtered by the fuel filter 43. Thereafter, the fuel fills in the inside of the valve housing 2, that is, the hollow part of the fuel intake cylinder 26, the first longitudinal hole 19 of the fixed core 5, the second longitudinal hole 20 and the traverse hole 21 of the valve assembly V, as well as the large-diameter hole 17, the taper hole 16, the valve body guide hole 15 and the like of the valve seat member 3. While the coil 30 is demagnetized, the valve assembly V is pressed forward by an urging force of the valve spring 22, and the valve body 18 is accordingly seated on the valve seat 8.

Once the coil 30 is excited by its electrification, the magnetic flux produced by the excitation sequentially travels through coil housing 31, the magnetic cylindrical body 4, the movable core 12, and the fixed core 5. Thereby, the movable core 12 is attracted to the fixed core 5 against the set load for the valve spring 22 due to attraction induced by a magnetic force produced between the two cores 5, 12. Thus, the valve body 18 leaves the valve seat 8, and the valve hole 7 is accordingly opened. Thus, the high-pressure fuel inside the valve seat member 3 goes out through the valve hole 7, and is injected to an air intake passage of a throttle body (not illustrated) or an engine (not illustrated), to which the electromagnetic fuel injection valve I is attached, through the fuel injection holes 11 of the injector plate 10.

In this respect, particularly, the high-pressure fuel having been on standby in the second longitudinal hole 20 of the valve assembly V, first of all, flows smoothly to the large-diameter hole 17 side with a relatively large volume in the valve seat member 3 through the single traverse hole 21 provided in the valve shaft 13. For this reason, the pressure loss is small. Subsequently, the high-pressure fuel having moved to the large-diameter hole 17 is guided to the valve body guide hole 15 at a progressively higher flow speed while the flow of the high-pressure fuel is smoothly reduced by the taper hole 16. After passing through the multiple passage portions 18, 18 in the outer periphery of the valve body 14, the high-pressure fuel reaches the valve hole 7 at an increasingly much higher flow speed while the flow of the high-pressure fuel is further reduced by the cone-shaped valve seat 8. Afterward, the high-pressure fuel is injected at a high speed through the fuel injection holes 11 of the injector plate 10. For this reason, the injected fuel can be atomized in a good condition.

In the meantime, the traverse hole 21 is provided in the valve shaft 13, while only the second longitudinal hole 20 passes through the movable core 12. For this reason, it is possible to avoid a decrease in the capacity of the movable core 12 which would otherwise be caused by the transverse 21. This can contribute to making the movable core 12 compact in size, and resultantly the electromagnetic fuel injection valve I compact in size. Furthermore, the number of traverse holes 21 provided to the valve shaft 13 is limited to one. For this reason, when the traverse hole 21 is made through electrical discharge machining or mechanical machining, the amount of burr which is produced in the process can be minimized, and work for deburring can be facilitated. This can contribute to cost reduction. But also it is possible to reduce the diameter of the valve shaft 13 while securing the strength of the valve shaft 13. In conjunction with this, it is possible to increase the effective volume of the large-diameter hole 17.

Moreover, as described above, the relationship between the diameter D1 of the valve body guide hole 15 and the diameter D2 of the large-diameter hole 17 is $D2/D1<0.6$. For this reason, it is possible to effectively increase the flow speed of the high-pressure fuel from the large-diameter hole 17 to the valve body guide hole 15. Furthermore, it is possible to reduce the diameter of the spherical valve body 14 which is supported by the valve body guide hole 15. This makes it possible to provide the small-sized electromagnetic fuel injection valve I of a small injection flow rate type which is effective, especially, for a small-sized two-wheeled motor vehicle or the like.

Besides, the taper angle θ of the taper hole 16, which connects the large-diameter portion 17 and the valve body guide hole 15 together, is set at 50° to 70°. For this reason, it is possible to reduce the flow of the high-pressure fuel more smoothly in the taper hole 16. In addition, in cooperation with the above-mentioned Expression (1), it is possible to inhibit an increase in the total length of the valve seat member 3 to an utmost extent. This can contribute to making the electromagnetic fuel injection valve I compact in size.

In addition, the valve shaft 13 is formed from: the hollow shaft portion 13*a* whose diameter is smaller than that of the movable core 12 and almost equal to that of the valve body guide hole 15, and which has the second longitudinal hole 20; and the solid shaft portion 13*b* which integrally continues to the front end of the hollow shaft portion 13*a* via the taper stepped portion 13*c*, and whose diameter is smaller than that of the valve body guide hole 15. For this reason, it is possible to simultaneously achieve the reduction in the thickness and weight of the valve shaft 13 and the securing of the strength of the valve shaft 13.

At that time, the cylinder-shaped passage 25 is defined between the solid shaft portion 13*b* and the inner peripheral surface of the valve body guide hole 15 by plunging the front-end portion of the hollow shaft portion 13*a* into the valve body guide hole 15. For this reason, the flow of the high-pressure fuel, which is reduced by the taper hole 16, is straightened by the cylinder-shaped passage 25, and is thereafter divided and made to flow into the multiple passage portions 18, 18 in the outer periphery of the valve body 14. Despite the single traverse hole 21, the amounts of the flows divided into the passage portions 18 can be made equal. Accordingly, it is possible to stabilize the direction in which the fuel is injected from the fuel injection holes 11.

An embodiment of the present invention is explained above, but the present invention is not limited to the above-mentioned embodiment and may be modified in a variety of ways as long as the modifications do not depart from the spirit and scope thereof. For example, the outer peripheral surface of the valve body 14 may be provided with groove-shaped passage portions instead of the flat passage portions 18.

The invention claimed is:

1. An electromagnetic fuel injection valve including: a valve housing (2) including a valve seat member (3), a fixed core (5) and a fuel intake cylinder (26) which are connected in a fore-and-aft direction, an inside of the valve housing (2) serving as a fuel passage, and the valve seat member (3) having a valve seat (8) and a valve hole (7) at a front end thereof; a coil (30) placed around an outer periphery of the valve housing (2), and electrified in order to excite the fixed core (5); and a valve assembly (V) which is housed in the valve housing (2), and opens and closes the valve hole (7) in cooperation with the valve seat (8) in conjunction with demagnetization and excitation of the fixed core (5), the valve assembly (V) including a valve body (14), a movable core (12) and a valve shaft (13), the valve body (14) being detached from and seated on the valve seat (8), having a spherical basic shape, and having a plurality of passage portions (18) in an outer periphery thereof, the movable core (12) being slidably fitted into the valve housing (2), and the valve shaft (13) being integrally projectingly provided to a front end of the movable core (12) and connected to the valve body, having a diameter smaller than that of the movable core (12), characterized in that the valve seat member (3) is provided with: a valve body guide hole (15) which continues to the valve seat (8) and slidably guides the valve body (14); and a large-diameter hole (17) which continues to a rear end of the valve body guide hole (15) via a taper hole (16), and whose diameter is larger than that of the valve body guide hole (15), the fixed core (5) is provided with a first longitudinal hole (19) which communicates with an inside of the fuel intake cylinder (26), a second longitudinal hole (20) communicating with the first longitudinal hole (19) is provided, stretching from the movable core (12) to the valve shaft (13), the valve shaft (13) is provided with a single traverse hole (21) which makes the second longitudinal hole (20) open to the large-diameter hole (17), and the valve shaft (13) includes a hollow shaft portion (13*a*) having the second longitudinal hole (20); and a solid shaft portion (13*b*) which is solid, has a diameter smaller than that of the hollow shaft portion (13*a*), and continues to a front end of the hollow shaft portion (13*a*), and a cylinder-shaped passage (25)

is defined between the solid shaft portion (13*b*) and an inner peripheral surface of the valve body guide hole (15) by plunging a front-end portion of the solid shaft portion (13*b*) into the valve body guide hole (15), and the hollow shaft portion (13*a*) is provided with the traverse hole (21).

2. The electromagnetic fuel injection valve according to claim 1, wherein a taper angle (θ) of the taper hole (16) is set at 50° to 70°, and a relationship between a diameter D1 of the large-diameter hole (17) and a diameter D2 of the valve body guide hole (I5) is D2/D1<0.6.

3. The electromagnetic fuel injection valve according to claim 2, wherein the electromagnetic fuel injection valve is used for a small-sized two-wheeled motor vehicle.

* * * * *